US008296132B2

(12) United States Patent
Zhang et al.

(10) Patent No.: US 8,296,132 B2
(45) Date of Patent: Oct. 23, 2012

(54) APPARATUS AND METHOD FOR COMFORT NOISE GENERATION

(75) Inventors: Deming Zhang, Shenzhen (CN); Jinliang Dai, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 272 days.

(21) Appl. No.: 12/748,190

(22) Filed: Mar. 26, 2010

(65) Prior Publication Data

US 2010/0191522 A1 Jul. 29, 2010

Related U.S. Application Data

(63) Continuation of application No. PCT/CN2008/072514, filed on Sep. 25, 2008.

(30) Foreign Application Priority Data

Sep. 28, 2007 (CN) ..... 2007 1 0151408

(51) Int. Cl.
*G10L 19/00* (2006.01)

(52) U.S. Cl. ..... 704/201; 704/206; 704/210

(58) Field of Classification Search ..... 704/201, 704/206, 210, 215, 270.1
See application file for complete search history.

(56) References Cited

U.S. PATENT DOCUMENTS

| | | | | |
|---|---|---|---|---|
| 5,794,199 | A * | 8/1998 | Rao et al. | 704/258 |
| 5,960,389 | A * | 9/1999 | Jarvinen et al. | 704/220 |
| 6,643,617 | B1 * | 11/2003 | Wood et al. | 704/226 |
| 6,654,613 | B1 * | 11/2003 | Maeng et al. | 455/522 |
| 7,454,010 | B1 * | 11/2008 | Ebenezer | 379/392.01 |
| 7,536,298 | B2 * | 5/2009 | Ramkumar et al. | 704/201 |
| 2001/0014857 | A1 * | 8/2001 | Wang | 704/231 |
| 2004/0204934 | A1 * | 10/2004 | Stephens et al. | 704/226 |
| 2005/0203733 | A1 * | 9/2005 | Ramkummar et al. | 704/223 |

FOREIGN PATENT DOCUMENTS

| | | | |
|---|---|---|---|
| CN | 1367918 | A | 9/2002 |
| CN | 1758694 | A | 4/2006 |
| EP | 0843301 | A2 | 5/1998 |
| JP | 08-305395 | A | 11/1996 |
| JP | 2003501925 | A | 1/2003 |
| JP | 2008546341 | A | 12/2008 |
| WO | WO 00/75919 | A1 | 12/2000 |
| WO | WO 2005/091273 | A2 | 3/2005 |

OTHER PUBLICATIONS

European Patent Office, Examination Report in European Patent Application No. 08800986.5 (Aug. 25, 2010).
State Intellectual Property Office of the People's Republic of China, Examination report in Chinese Patent Application No. 200710151408.9 (Jun. 5, 2009).
1st Office Action in corresponding Chinese Application No. 200810189642.5 (Mar. 3, 2011).
First Office Action in counterpart Chinese Application No. 200710151408.9, mailed Jun. 19, 2009.

(Continued)

*Primary Examiner* — James Wozniak
(74) *Attorney, Agent, or Firm* — Leydig, Voit & Mayer

(57) ABSTRACT

The disclosure provides a method for noise generation, including: determining an initial value of a reconstructed parameter; determining a random value range based on the initial value of the reconstructed parameter; taking a value in the random value range randomly as a reconstructed noise parameter; and generating noise by using the reconstructed noise parameter. The disclosure also provides an apparatus for noise generation.

17 Claims, 4 Drawing Sheets

OTHER PUBLICATIONS

Second Office Action in counterpart Chinese Application No. 200710151408.9, mailed Oct. 30, 2009.
Written Opinion in counterpart PCT Application No. PCT/CN2008/072514, mailed Jan. 8, 2009.
Extended European Search Report in counterpart European Application No. 08800986.5-2225, mailed Aug. 25, 2010.
"3rd Generation Partnership Project; Technical Specification Group Services and System Aspects; Mandatory speech codec speech processing functions; Adaptive Multi-Rate (AMR) speech codec; Comfort noise aspects (Release 6)," *3GPP*, 3GPP TS 26.092 V6.0.0 (Dec. 2004).
"3rd Generation Partnership Project; Technical Specification Group Services and System Aspects; Speech codec speech processing functions; Adaptive Multi-Rate-Wideband (AMR-WB) speech codec; Comfort noise aspects (Release 6)," *3GPP*, 3GPP TS 26.192 V6.0.0 (Dec. 2004).
"Series G: Transmission Systems and Media—Digital transmission systems—Terminal equipments—Coding of analogue signals by methods other than PCM—Coding of speech at 8 kbit/s using conjugate structure algebraic-code-excited linear-prediction (CS-ACELP)—Annex B: A silence compression scheme for G.729 optimized for terminals conforming to Recommendation V.70," *International Telecommunication Union*, ITU-T Recommendation No. G.729—Annex B (Nov. 1996).
1st Office Action in corresponding European Application No. 08800986.5 (Jun. 15, 2011).
2nd Office Action in corresponding European Application No. 08800986.5 (Sep. 19, 2011).
International Search Report in corresponding PCT Application No. PCT/CN2008/072514 (Jan. 8, 2009).
Office Action in corresponding Japanese Patent Application No. 2010-526136 (Mar. 27, 2012).
1st Office Action in corresponding Canadian Patent Application No. 2,701,902 (Jul. 18, 2012).
Determination of Allowance in corresponding Japanese Patent Application No. 2010-526136 (Aug. 21, 2012).

* cited by examiner

APPARATUS AND METHOD FOR COMFORT NOISE GENERATION

CROSS-REFERENCE TO RELATED APPLICATIONS

This application is a continuation of International Application No. PCT/CN2008/072514, filed on Sep. 25, 2008, which claims priority to Chinese Patent Application No. 200710151408.9, filed on Sep. 28, 2007, both of which are hereby incorporated by reference in their entireties.

FIELD OF THE INVENTION

The present invention relates to the technical field of communications, and more particularly, to an apparatus and method for noise generation.

BACKGROUND

During voice transmission, speech coding techniques are generally used to compress voice message so that the capacity of a communication system may be improved.

During voice communication, speech only occupies about 40% of a time period, with the remaining time period being occupied by silence or background noise. Generally speaking, people involved in voice communication are concerned about the content of the speech only, while they are not concerned about the time period only having silence or background noise. Therefore, when voice message is being compressed, different methods are used for encoding and transmitting voice message, silence, or background noise so as to further improve the capacity of the communication system. Discontinuous Transmission System/Comfortable Noise Generation (DTX/CNG) is such a technique for further improving the capacity of the communication system.

A frame obtained by encoding the background noise with the DTX/CNG technology is generally referred to as a Silence Insertion Descriptor (SID) frame. An ordinary speech frame contains a spectral parameter, a signal energy gain parameter, as well as parameters associated with a fixed codebook and an adaptive codebook. Upon receiving a speech frame, the decoder may recover the original speech data based on such information. However, an SID frame generally only contains a spectral parameter and a signal energy gain parameter. The decoder may recover the background noise based on the spectral parameter and the signal energy gain parameter. This is due to the fact that users generally do not care what information is contained in the background noise. Accordingly, an SID frame may only deliver a small amount of reference information, i.e. the spectral parameter and the signal energy gain parameter. Based on such reference information, the decoder may recover the background noise so that the user may generally know what environment his/her counterpart is in and the listening quality experienced by the user will not be influenced obviously. During voice transmission, an SID frame is sent at an interval of several frames. A frame in which no coded parameter is sent or no parameter is coded at all may generally be referred to as a NO_DATA frame.

The DTX/CNG technology is widely applied in recent speech coding standards developed by various organizations and institutions.

The DTX/CNG technology is adopted in the speech coding standard—Adaptive Multi-Rate (AMR), developed by the Third Generation Partnership Projects (3GPP). SID frames are sent at fixed intervals, that is, every 8 frames. By using parameters decoded from two consecutively received SID frames, that is, the signal energy gain parameter and the spectral parameter, a linear interpolation is performed to estimate the parameters necessary for noise synthesis, which may be given by:

$$P_{n+k} = \frac{8-k}{8} P_{sid(n-1)} + \frac{k}{8} P_{sid(n)} \quad (k = 1, \ldots, 8)$$

where $P_{n+k}$ represents the estimated value of the CNG parameter for the $k^{th}$ frame subsequent to the $n^{th}$ SID frame, $P_{sid(n-1)}$ represents the parameter for the $(n-1)^{th}$ SID frame received by the decoder, and $P_{sid(n)}$ represents the parameter for the $n^{th}$ SID frame received by the decoder. When n=0, $P_{sid(-1)}$ represents the average value of the spectral parameters and signal energy gain parameters for the 8 speech frames in the tail period.

The DTX/CNG technology is also adopted in the speech coding standard—the silence compression scheme defined by the conjugate structure algebra code excited linear prediction speech codec, developed by the International Telecommunication Union (ITU). The encoder may determine adaptively whether to send an SID frame based on changes in the noise parameter. The interval between two consecutive SID frames should be at least 20 ms and have no maximum. The CNG algorithm used at the decoder may be given as follows.

For reconstruction of the signal energy gain parameter:

$$\tilde{G}_t = \begin{cases} \tilde{G}_{sid_new} \\ \frac{7}{8}\tilde{G}_{t-1} + \frac{1}{8}\tilde{G}_{sid_new} \end{cases}$$

if the previous frame is a speech frame;

if the previous frame is not a speech frame.

For reconstruction of the spectral parameter:

$$LSF_{t,sub_1} = \begin{cases} \frac{1}{2}(LSF_{sid_last} + LSF_{sid_new}) \\ LSF_{sid_new} \end{cases}$$

$$LSF_{t,sub_2} = LSF_{sid_new}$$

if the previous frame is a speech frame;

if the previous frame is not a speech frame where $\tilde{G}_{sid_new}$ represents the signal energy gain parameter decoded from an SID frame newly received at the decoder, $LSF_{sid_last}$ represents the spectral parameter decoded from an SID frame lastly received at the decoder, and $LSF_{sid_new}$ represents the spectral parameter decoded from an SID frame newly received at the decoder.

The following problems appear in the conventional art.

For the speech coding standard of 3GPP—the DTX/CNG technology used in AMR, the encoder can only send SID frames at fixed intervals. If the encoder sends SID frames at adaptive intervals, the system cannot work normally.

For the speech coding standard of ITU—the DTX/CNG technology used in the silence compression scheme defined by the conjugate structure algebra code excited linear prediction vocoder, when the current frame is an SID frame, the spectrum parameter of the first sub-frame in the current frame is generated by averaging the decoded spectrum parameter in current frame and the spectrum parameter of previous SID frame, and the decoded spectral parameter is used directly as the spectral parameter for the second sub-frame. For a NO_DATA frame before the arrival of the next SID frame, the decoded spectral parameter for the latest SID frame is used directly for noise reconstruction. When the next SID frame arrives and there is a difference between the decoded spectral parameter and the spectral parameter for the previous SID frame, discontinuity may occur. Furthermore, since the spectral parameter is a variable in constant change and hence there generally is a difference between two consecutive spectral parameters, the spectrum of the reconstructed comfortable noise tends to be discontinuous, which in turn affects the listening quality, especially when there is a big difference between two consecutive spectral parameters.

SUMMARY

The technical problem to be solved in an embodiment of the invention is to provide a method and apparatus for noise generation, which may accommodate various standard protocols so that the decoder may recover noise comfortable to the users.

To solve the above technical problem, an embodiment of the invention provides a method for noise generation, including:

determining an initial value of a reconstructed parameter;

determining a random value range based on the initial value of the reconstructed parameter;

taking a value in the random value range randomly as a reconstructed noise parameter; and generating noise by using the reconstructed noise parameter.

An embodiment of the invention provides an apparatus for noise generation, including:

an initial value unit, configured to determine an initial value of a reconstructed parameter;

a range unit, configured to determine a random value range based on the initial value of the reconstructed parameter;

a reconstruction unit, configured to take a value in the random value range randomly as a reconstructed noise parameter; and a synthesizing unit, configured to generate noise by using the reconstructed noise parameter.

From the above technical solution, it can be seen that there is no limit to the protocol standard used at the encoder in the embodiments of the invention. The technical solution of the invention is operable whether the encoder transmits SID frames at fixed intervals or transmits SID frames at adaptive intervals. Moreover, upon receiving a new SID frame subsequent to the receiving of the first SID frame, the reconstructed noise parameter for a frame previous to the newly received SID frame will be taken as the initial value of the reconstructed parameter. With reference to the initial value of the reconstructed parameter and the noise parameter for the newly received SID frame, a random value range is determined. A value is taken randomly in the range as the noise parameter. Thus, the transition of the generated noise is more natural and a better listening experience is brought to the user.

DETAILED DESCRIPTION

The embodiments of the invention provide an apparatus and a method for noise generation, which may accommodate various standard protocols so that the decoder may recover noise comfortable to the users.

In a method for noise generation according to an embodiment of the invention, the decoder may use the noise parameters of a small number of SID frames to reconstruct a noise parameter having a random change and a smooth curve. In this manner, it may facilitate recovery of noise comfortable to the users.

Figure 1:
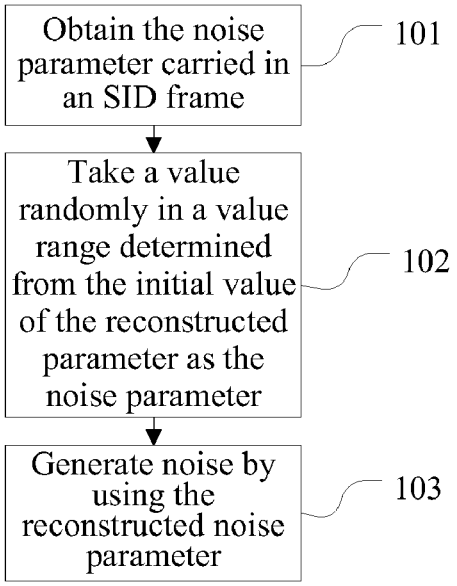
FIG. 1 is a flow chart showing a method for noise generation according to one embodiment of the invention.

The flow of the method for noise generation according to embodiment One of the invention is shown in FIG. 1.

In step 101, the noise parameter carried in an SID frame is obtained.

After voice communication is started, the decoder may decode information of a frame from the received data packets. Then, a determination is made regarding the format of the frame. If the frame is a speech frame, a speech frame processing flow is started. If the frame is a non-speech frame, such as an SID frame or NO_DATA frame, the flow of the method for noise generation as provided in this embodiment is started.

When a non-speech frame is processed, the procedure directly proceeds to step 102 because the NO_DATA frame contains no speech data. Upon receiving an SID frame, the noise parameter carried in the SID frame is obtained, that is, the signal energy gain parameter and the spectral parameter.

In step 102, based on the obtained noise parameter, continuous noise parameters changing randomly with the predicted direction and having a smooth curve may be reconstructed, the continuous noise parameters including the signal energy gain parameter and the spectral parameter.

The current frame, that is, the frame whose noise parameters are to be reconstructed currently, may be a non-speech frame, including SID frame and NO_DATA frame.

To prevent the reconstructed noise parameter from departing too far away from the actual value, a center value is determined first for the changing curve of the reconstructed noise parameter so that the value of the reconstructed noise parameter floats around the center value. This center value may be referred to as a floating center $C_k$. Meanwhile, the floating range has to be determined so that the value of the reconstructed noise parameter floats in the range having $C_k$ as its center. This floating range may be referred to as a floating radius $\Delta$.

There are various methods for obtaining the floating radius $\Delta$. Two of the methods are provided in this embodiment. According to one method, the floating radius may be obtained according to the noise parameter increment dP, the predicted interval length length, and the time interval k between the current frame and the newly received SID frame. According another method, the floating radius may be obtained according to the noise parameter increment dP and the predicted interval length length.

When the floating radius $\Delta$ is obtained according to the first method, the floating radius $\Delta$ for the noise parameter of the current frame may be obtained according to the following equation:

$$\Delta = \frac{dP}{2(|k - \text{length}| + 1)}$$

where length is the predicted length of the interval between the newly received SID frame and the next SID frame. In other words, it is assumed that the next SID frame may be received after the time period length.

When the current frame is the first SID frame received by the decoder subsequent to the speech frame, the noise parameter increment dP may be obtained by using the noise parameter $P_{sid}$ for the newly received SID frame or the energy gain parameter and the spectral parameter of the several previous speech frames stored in the buffer.

When the decoder receives the first non-speech frame subsequent to the speech frame, two methods for obtaining the noise parameter increment are provided according to some embodiments.

Method 1: The energy gain parameters and the spectral parameters of a few previous speech frames stored in the buffer may be used for estimating the previous average energy gain parameter and spectral parameter as the initial value of the reconstructed parameter $P_{ref}$. The difference between the newly received noise parameter $P_{sid}$ and the initial value of the reconstructed parameter $P_{ref}$ may be taken as the noise parameter increment dP. In this case, the noise parameter increment dP may be obtained according to the following equation:

$$dP=P_{sid}-P_{ref}.$$

Estimation of the initial value of the reconstructed parameter $P_{ref}$ may vary. The average value of the energy gain parameters and spectral parameters of several previous frames may be taken as the initial value of the reconstructed parameter $P_{ref}$. Alternatively, the weighted average value of the energy gain parameters and spectral parameters of several previous frames may be taken as the initial value of the reconstructed parameter $P_{ref}$.

Method 2: By directly using the energy gain parameter and spectral parameter carried in a newly received SID frame, the noise between the newly received SID frame and the next SID frame may be reconstructed. Upon receiving an SID frame next to the newly received SID frame, reconstruction of the noise parameter starts. The energy gain parameter and spectral parameter carried in the first SID frame subsequent to the speech frame may be taken as the initial value of the reconstructed parameter $P_{ref}$, and the difference between the newly received noise parameter $P_{sid}$ and the initial value of the reconstructed parameter $P_{ref}$ may be taken as the noise parameter increment dP. Now, the noise parameter increment dP may be obtained according to the following equation:

$$dP=P_{sid}-P_{ref}.$$

If the current frame is an SID frame received after the first SID frame or a NO_DATA frame subsequent to the first SID frame, two methods for obtaining the noise parameter increment are provided according to some embodiments.

Method 1: The reconstructed noise parameter $P_{k-1}$ of a frame previous to the newly received SID frame is taken as the initial value of the reconstructed parameter $P_{ref}$, and the difference between the noise parameter $P_{sid}$ of the newly received SID frame and the initial value of the reconstructed parameter $P_{ref}$ is taken as the noise parameter increment dP. Now, the noise parameter increment dP may be obtained according to the following equation:

$$dP=P_{sid}-P_{ref}.$$

Method 2: The difference between the noise parameter carried in the newly received SID frame and the noise parameter carried in the previous SID frame is taken as the noise parameter increment dP. In an example where the newly received SID frame is the $n^{th}$ frame, the noise parameter increment dP may be obtained according to the following equation:

$$dP=P_{sid(n)}-P_{sid(n-1)}.$$

Before receiving the next SID frame, when the noise parameter is to be reconstructed for a NO_DATA frame between two SID frames, the noise parameter increment dP for the newly received SID frame may be used for determining the floating radius Δ for the NO_DATA frame. Also, the noise parameter increment dP is updated whenever noise is reconstructed for a new NO_DATA frame. Some embodiment provides two methods for updating the noise parameter increment dP.

Method 1: The difference between the noise parameter $P_{sid}$ of the newly received SID frame and the initial value of the reconstructed parameter $P_{ref}$ is taken as the noise parameter increment dP. When the noise parameter is reconstructed for a NO_DATA frame, the reconstructed noise parameter $P_{k-1}$ for the previous frame is used for updating the initial value of the reconstructed parameter $P_{ref}$. The noise parameter increment dP obtained by using the initial value of the reconstructed parameter $P_{ref}$ will be updated accordingly.

Method 2: The difference between the noise parameter of the newly received SID frame and the noise parameter carried in the previous SID frame is taken as $d_0$, the reconstructed noise parameter of a frame previous to the newly received SID frame is taken as $P_0$, the current frame is the $k^{th}$ frame from the newly received SID frame, and the noise parameter increment for the current frame is $d_k$. The noise parameter increment $d_k$ of the current frame may be obtained by subtracting the difference between the initial value of the reconstructed parameter and $P_{ref}$ and $P_0$ from $d_0$ so that $d_k$=dp. Now, $d_k$ may be obtained according to the following equation:

$$d_k=d_0-(P_{ref}-P_0).$$

When reconstructing the noise parameter for the NO_DATA frame, the initial value of the reconstructed parameter $P_{ref}$ may be updated by using the reconstructed noise parameter $P_{k-1}$ of the previous frame. Then, the noise parameter increment $d_k$ obtained by using the initial value of the reconstructed parameter $P_{ref}$ will be updated accordingly.

The predicted direction of the changing curve is also the value direction of the floating radius Δ. The value direction of the floating radius Δ is under the influence of the noise parameter increment dP. When the noise parameter increment dP is "+", the value of Δ is "+". When the noise parameter increment dP is "−", the value of Δ is "−".

When the current frame is an SID frame, k is "0", $$2(|k - \text{length}| + 1) = 2(\text{length} + 1)$$

$$\Delta = \frac{dP}{2(\text{length} + 1)}$$

As the duration of a NO_DATA segment consisting of NO_DATA frames becomes longer, the value k becomes greater slowly. When the noise parameter increment dP keeps unchanged, the value of 2(|k−length|+1) will become smaller slowly, and the value of k becomes greater slowly.

When k=length, that is, the current frame is the $\text{length}^{th}$ frame after the newly received SID frame, $$2(|k-\text{length}|+1)_{=2}$$

$$\Delta = \frac{dP}{2}$$

If no new SID frame is received after the frame, the value of k continues to increase. When the noise parameter increment dP keeps unchanged, the value of 2(|k−length|+1) will become greater slowly, and the value Δ will become smaller slowly.

When the noise parameter is reconstructed for a NO_DATA frame between two SID frames and the noise parameter increment dP keeps unchanged, the value of Δ is a value which has an initial value equal to $$\frac{dP}{2(\text{length}+1)}$$

and an maximum equal to $$\frac{dP}{2},$$

and then fades slowly. If the noise parameter increment dP changes accordingly, the change in the value of Δ will be influenced accordingly.

When obtaining the floating radius Δ with the second method, the floating radius Δ for the noise parameter of the current frame may be obtained according to the following equation:

$$\Delta = \frac{dP}{2*\text{length}}$$

The method for obtaining the noise parameter increment dP and the predicted interval length length is substantially similar to the above first method for obtaining the floating radius Δ.

In such case, the value direction of the floating radius Δ is still influenced by the noise parameter increment dP. When the noise parameter increment dP is "+", the value of Δ is "+"; when the noise parameter increment dP is "−", the value of Δ is "−".

The floating center $C_k$ for the noise parameter of the current frame may be obtained via the initial value of the reconstructed parameter $P_{ref}$ and the floating radius Δ for the noise parameter of the current frame. The floating center $C_k$ may be obtained according to the following equation:

$$C_k=P_{ref}+2\Delta$$

Here, the initial value of the reconstructed parameter $P_{ref}$ will be updated each time the noise parameter is reconstructed. It is assumed that the current noise parameter is $P_k$ and $P_{ref}$ is updated with $P_{k-1}$. The floating center $C_k$ may then be written as:

$$C_k=P_{k-1}+2\Delta$$

With $C_k$ as the center, a method may be used for taking a random value within the interval $[C_k-|\Delta|,C_k+|\Delta|]$, and then the noise parameter $P_k$ of the current frame may be reconstructed. The noise parameter $P_k$ may be written as:

$$P_k=\text{rand}(C_k-|\Delta|,C_k+|\Delta|)$$

When the current frame is an SID frame and the Δ value is "+", $C_k$ is greater than the noise parameter $P_{k-1}$ of the previous frame, and the minimum of $[C_k-|\Delta|,C_k+|\Delta|]$ is:

$$C_k-|\Delta|=P_{k-1}+\Delta$$

The minimum of $[C_k-|\Delta|,C_k+|\Delta|]$ is higher than $P_{k-1}$ by Δ. When Δ is obtained with the first method, the initial value of the value Δ is equal to $$\frac{dP}{2(\text{length}+1)},$$

which is $$\frac{1}{2(\text{length}+1)}$$

of the noise parameter increment dP. This is very small relative to the noise parameter increment dP. Therefore, the minimum of $[C_k-|\Delta|,C_k+|\Delta|]$ is a value slightly higher than $P_{k-1}$.

When Δ is obtained with the second method, $$\Delta = \frac{P_{sid}-P_{k-1}}{2*\text{length}}.$$

The value of Δ is $$\frac{1}{2*\text{length}}$$

of the noise parameter increment, which is very small relative to the noise parameter increment dP. Therefore, the minimum of $[C_k-|\Delta|,C_k+|\Delta|]$ is also a value slightly higher than $P_{k-1}$.

The maximum of $[C_k-|\Delta|,C_k+|\Delta|]$ is:

$$C_k+|\Delta|=P_{k-1}+3\Delta$$

The maximum of $[C_k-|\Delta|,C_k+|\Delta|]$ is higher than $P_{k-1}$ by 3Δ. When Δ is obtained with the first method, for example, when the value of length is "2", the value of 3Δ is ½ of the noise parameter increment dP, which is still smaller than the noise parameter increment dP. In other words, the maximum of $[C_k-|\Delta|,C_k+|\Delta|]$ is lower than the sum of $P_{k-1}$ and the noise parameter increment dP.

When Δ is obtained with the second method, for example, when the value of length is "2", the value of 3Δ is ¾ of the difference between $P_{sid}$ and $P_{k-1}$, which is still smaller than the noise parameter increment dP. In other words, the maximum of $[C_k-|\Delta|,C_k+|\Delta|]$ is lower than the sum of $P_{k-1}$ and the noise parameter increment dP. Moreover, the second method generally is applied to cases where SID frames are sent at fixed intervals. In these cases, length is typically much greater than "2", and hence the value of 3Δ is even smaller.

Similarly, if the current frame is an SID frame and the value Δ is "−", the minimum of $[C_k-|\Delta|,C_k+|\Delta|]$ will be higher than the noise parameter $P_{sid}$ of the newly received SID frame, and the maximum will be slightly lower than the noise parameter $P_{k-1}$ of the previous frame.

Therefore, when the current frame is an SID frame, the noise parameter $P_k$ taking a random value within the interval of $[C_k-|\Delta|,C_k+|\Delta|]$ will be a parameter having a slight change compared with the noise parameter $P_{k-1}$ of the previous frame. Such a change is a mild change influenced by the noise parameter $P_{sid}$ of the newly received SID frame. Even if the noise parameter $P_{sid}$ of the newly received SID frame is distinctly different from the noise parameter $P_{k-1}$ of the previous frame, $P_k$ is a value having a smooth transition. The noise generated from $P_k$ will also change slightly and thus may bring better user experience.

When the current frame is a NO_DATA frame, the initial value of the reconstructed parameter $P_{ref}$ is the reconstructed noise parameter $P_{k-1}$ of the previous frame. The floating center $C_k$ is influenced by the initial value of the reconstructed parameter $P_{ref}$, and will change smoothly towards the value direction of the floating radius Δ. The noise parameter $P_k$ having a random value within the interval of $[C_k-|\Delta|,C_k+|\Delta|]$ may be a parameter changed slightly with respect to the noise parameter $P_{k-1}$ of the previous frame. The continuous noise parameter $P_k$ reconstructed between two SID frames will be a value having a smooth transition. The noise generated from $P_k$ will also change slightly and thus may bring better user experience.

Further, the floating radius Δ between two SID frames might change under the influence of the value of k or the value of dP. The range of the random value will also change accordingly. The continuous noise parameter $P_k$ reconstructed between two SID frames will be a curve changing more randomly. The noise generated from $P_k$ will also change more differently and thus may bring better user experience.

In some cases, when the current frame is a NO_DATA frame, it is likely that the initial value of the reconstructed parameter $P_{ref}$ will not be updated before the arrival of the next SID frame. The change of the range of the random value depends on the change of the floating radius Δ.

In this embodiment, the initial value of the reconstructed parameter $P_{ref}$ includes the initial value of the reconstructed signal energy gain parameter and the initial value of the reconstructed spectral parameter.

In step 103, noise is generated by using the reconstructed noise parameter.

The decoder uses a random sequence generator to synthesize an excitation signal. When noise is reconstructed, the excitation signal is equivalent to what an SID frame lacks as compared to an ordinary speech frame, for example, parameters associated with the fixed codebook and the adaptive codebook, etc. Based on the commonness of noise, the decoder uses a random sequence generator to synthesize an excitation signal for noise reconstruction.

There are two methods for noise generation by using the excitation signal and the reconstructed noise parameter.

In the first method, the decoder converts the spectral parameter in the reconstructed noise parameter to synthesis filter coefficients, performs a synthesis filtering on the excitation signal, and obtains a noise signal. Then, a time-domain shaping is performed on the synthesized noise signal by using the energy gain parameter in the reconstructed noise parameter. A post processing is performed, and the final reconstructed noise may be output.

In the second method, the decoder uses the energy gain parameter in the reconstructed noise parameter and the random sequence generator to synthesize an excitation signal. Then, the spectral parameter in the reconstructed noise parameter is converted to synthesis filter coefficients. Synthesis filtering is applied to the excitation signal to obtain a noise signal.

In this embodiment, there is no limit to the protocol standards used in the encoder. The technical solution of the invention is operable whether the encoder transmits SID frames at fixed intervals or transmits SID frames at adaptive intervals. Moreover, each time a new SID frame is received, noise parameter reconstruction will refer to the reconstructed noise parameter of the previous frame and the newly received noise parameter. Thus, the transition of the generated noise is natural and a better listening experience may be brought to the user. Furthermore, the influence of the actual noise parameter is referred to so that the user may discern the approximate speech environment. Further, when a NO_DATA frame is processed, a noise parameter slightly changed relative to the previous frame is reconstructed for the NO_DATA frame based on the distance between the NO_DATA frame and the latest SID frame, the changing direction of the noise parameter of the latest SID frame, and the difference between the noise parameter of the latest SID frame and the initial value of the reconstructed parameter. In this way, the changing curve of the reconstructed noise parameter is smooth. Accordingly, the transition of the generated noise is also natural between frames, and a better listening experience may be brought to the user.

Figure 2:
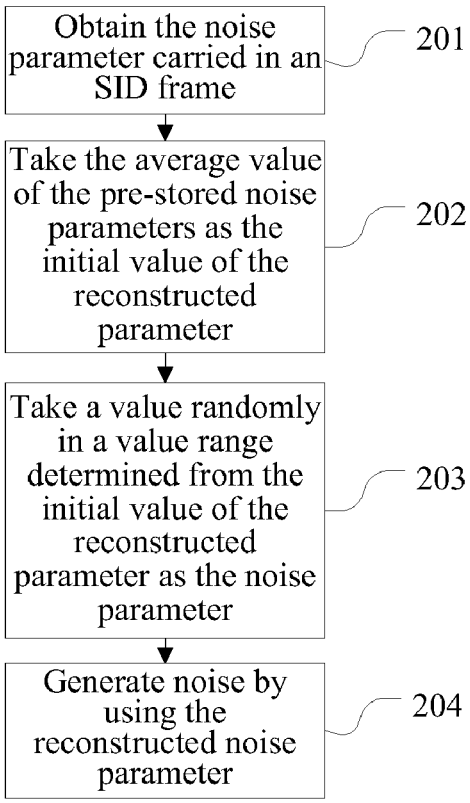
FIG. 2 is a flow chart showing a method for noise generation according to another embodiment of the invention.

In the method for noise generation according to embodiment Two of the invention, the encoder sends SID frames at adaptive intervals. The flow is shown in FIG. 2.

In step 201, an SID frame is received and the noise parameter carried in the SID frame is obtained.

After voice communication starts, the decoder may decode information of a frame from the received data packets. Then, a determination is made regarding the format of the frame. If the frame is a speech frame, the speech frame processing flow is started. If the frame is a non-speech frame, such as an SID frame or a NO_DATA frame, the flow of the method for noise generation as provided in this embodiment is started.

When a non-speech frame is processed, the procedure directly proceeds to step 202 because the NO_DATA frame contains no speech data. Upon receiving an SID frame, the noise parameter carried in the SID frame may be obtained, that is, the signal energy gain parameter $G_{sid}$ and the spectral parameter $lsf_{sid}$.

In step 202, the initial value of the reconstructed parameter is obtained.

When the decoder detects that the frame type is changing from a speech frame to a non-speech frame, that is, when receiving the first SID frame, the energy gain parameters and spectral parameters of the previous $N_p$ frames stored in the buffer may be used for calculating the average energy gain parameter $G_{ref}$ and spectral parameter $lsf_{ref}$ as the initial value of the reconstructed parameter. Here, the value of $N_p$ is an integer more than 0, for example, $N_p=5$. The previous frames may be speech frames or SID frames. Reconstruction of the initial value of the energy gain parameter $G_{ref}$ and reconstruction of the initial value of the spectral parameter $lsf_{ref}$ may be obtained according to the following equation:

$$lsf_{ref} = \frac{1}{N_p}\sum_{i=1}^{N_p} lsf_i$$

$$G_{ref} = \frac{1}{N_p}\sum_{i=1}^{N_p} G_i$$

If the received SID frame is not the first SID frame, the energy gain parameter and spectral parameter reconstructed for the frame previous to the SID frame may be used as the initial value of the reconstructed parameter.

When the noise parameter is reconstructed for the NO_DATA frame according to one embodiment, the initial value of the reconstructed parameter may be updated by using the energy gain parameter and spectral parameter reconstructed for the previous frame. Alternatively, the initial value of the reconstructed parameter may not be updated before the arrival of the next SID frame.

In step 203, the noise parameter is reconstructed.

When a transition occurs from the speech segment to the noise segment, in other words, when the first SID frame subsequent to the speech frame is received, the initial value of length is set to $N_p$. When another SID frame is received afterwards, the length of the interval between the latest SID frame and its previous SID frame is taken. To guarantee the efficiency of DTX, the transmission interval for SID frames is generally limited, that is, length must be greater than or equal to a natural number. For example, it is defined in the protocol G.729B release that length must be greater than or equal to 2.

The energy gain parameter decoded from the latest SID frame is $G_{sid}$ and the spectral parameter is $lsf_{sid}$. For the $k^{th}$ frame subsequent to the SID frame, the noise parameter increment $d_{k,G}$ of its energy gain parameter may be obtained according to the following equation:

$$d_{k,G}=G_{sid}-G_{ref}$$

The floating radius $\Delta_G$ of its energy gain parameter may be obtained according to the following equation:

$$\Delta_G = \frac{d_{k,G}}{2(|k-\text{length}|+1)}$$

The noise parameter increment $d_{k,lsf}$ of its spectral parameter may be written as:

$$d_{k,lsf}=lsf_{sid}-lsf_{ref}$$

The floating radius $\Delta_{lsf}^{i}$ of its spectral parameter may be written as:

$$\Delta_{lsf}^{i} = \frac{d_{k,lsf}}{2(|k-\text{length}|+1)} \quad i=1,2,\ldots,M$$

where M is the order of linear prediction of the spectral parameter.

Then, the floating center $C_{G,k}$ of the reconstructed energy gain parameter in the reconstructed noise parameter of the current frame may be obtained according to the following equation:

$$C_{G,k}=G_{ref}+2\Delta_G$$

The floating center $C_{lsf,k}^{i}$ of the reconstructed spectral parameter in the reconstructed noise parameter of the current frame may be obtained according to the following equation:

$$C_{lsf,k}^{i}=lsf_{ref}+2\Delta_{lsf}^{i}$$

The reconstructed energy gain parameter $G_k$ in the reconstructed noise parameter of the current frame may be obtained according to the following equation:

$$G_k=\text{rand}(C_{G,k}-|\Delta_G|, C_{G,k}+|\Delta_G|)$$

The reconstructed spectral parameter $lsf_k^{i}$ in the reconstructed noise parameter of the current frame may be obtained according to the following equation:

$$lsf_k^{i}=\text{rand}(C_{lsf,k}^{i}-|\Delta_{lsf}^{i}|, C_{lsf,k}^{i}+|\Delta_{lsf}^{i}|)$$

where function rand(a,b) represents taking a random value uniformly distributed in the interval [a, b].

When a new SID frame is received, the associated variables may be updated as follows:

$$\text{length}=k-1.$$

$$G_{ref}=G_{k-1};$$

$$lsf_{ref}=lsf_{k-1}^{i}; \text{ and}$$

$$\text{finally } k=1.$$

When a NO_DATA frame is received, the initial value of the reconstructed parameter is updated so that:

$$G_{ref}=G_k; \text{ and}$$

$$lsf_{ref}=lsf_k.$$

The initial value of the reconstructed parameter is updated, and then k=k+1.

The reconstruction of the noise parameter of the frame continues until a new SID frame is received.

In step 204, the reconstructed noise parameter is employed to generate noise.

A white noise excitation signal e(n) is generated by using a random sequence.

The reconstructed spectral parameter $lsf_k$ is employed to form a synthesis filter $a_k(z)$.

The synthesis filter is used to synthesis filter the generated excitation signal:

$$y_k(n)=e(n)*a_k(n)$$

Then, the reconstruct energy gain parameter $G_k$ is used to perform a time-domain shaping on the synthesized noise $y_k(n)$.

$$y(n) = y_k(n) \times \frac{G_k}{\sqrt{\sum_{i=0}^{N-1} y_k^2(n)}}$$

where N is the length of frame in which comfortable noise may be recovered at the decoder.

In this embodiment, step 204 uses the method for noise generation with the reconstructed noise parameter, that is, the above mentioned first method for noise generation with the excitation signal and the reconstructed noise parameter.

In this embodiment, there is no limit to the protocol standards used in the encoder. The technical solution of the invention is operable whether the encoder transmits SID frames at fixed intervals or transmits SID frames at adaptive intervals. Moreover, when a transition occurs from the speech segment to the noise segment, the noise parameter is reconstructed by taking the average energy gain parameter and spectral parameter of the latest speech segment as the initial value and referring to the newly received noise parameter. Thus, when a change occurs from the speech segment to the noise segment, the transition of the generated noise and the speech segment may be natural and the user may have a better listening experience. Meanwhile, due to reference to the influence of the actual noise parameter, the user may discern the approximate speech environment. Every time a new SID frame is received, the noise parameter is reconstructed by taking the reconstructed noise parameter of its previous frame as the initial value and referring to the newly received noise parameter. The transition of the generated noise is thus natural, and the user may have a better listening experience. Meanwhile, also due to reference to the influence of the actual noise parameter, the user may discern the approximate speech environment. Further, when a NO_DATA frame is processed, the noise parameter having a change slightly different from the previous frame is reconstructed for the NO_DATA frame based on the distance between the NO_DATA frame and the latest SID frame, the changing direction of the noise parameter of the latest SID frame, and the difference between the noise parameter of the latest SID frame and the initial value of the reconstructed parameter, so that the changing curve of the reconstructed noise parameter may be smooth. Therefore, the transition of the generated noise is natural between frames and a better listening experience may be brought to the user.

Figure 3:
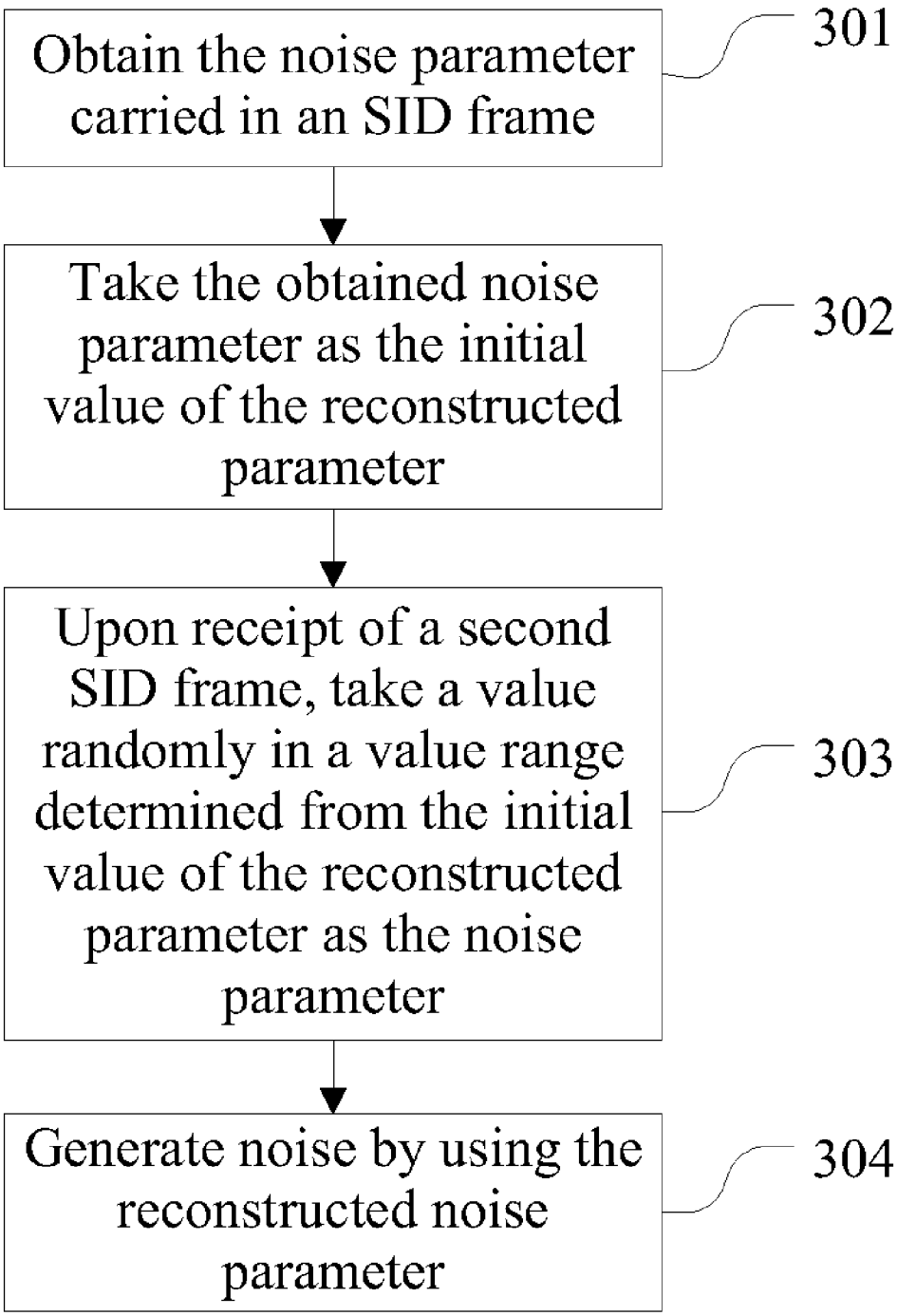
FIG. 3 is a flow chart showing a method for noise generation according to yet another embodiment of the invention.

With the method for noise generation as provided in embodiment Three of the invention, the encoder sends SID frames at fixed intervals. The flow chart is shown in FIG. 3.

In step 301, an SID frame is received and the noise parameter carried in the SID frame is obtained.

After voice communication starts, the decoder may decode information about a frame from the received data packets. Then, a determination is made regarding the format of the frame. If the frame is a speech frame, the speech frame processing flow is started. If the frame is a non-speech frame, such as an SID frame or NO_DATA frame, the flow of the method for noise generation as provided in this embodiment is started.

When a non-speech frame is processed, the procedure directly proceeds to step 302 because the NO_DATA frame contains no speech data. Upon receiving an SID frame, the noise parameter carried in the SID frame may be obtained, that is, the signal energy gain parameter $G_{sid}$ and the spectral parameter $lsf_{sid}$.

In step 302, the initial value of the reconstructed parameter is obtained.

The encoder sends SID frames at fixed SID frame intervals. It is assumed here that the SID frame interval is LENGTH, with the value of LENGTH being a natural number greater than 0.

When the decoder detects that the frame type is changing from a speech frame to a non-speech frame, that is, when receiving the first SID frame, the noise parameter of the received SID frame may be used as the reconstructed noise parameter of the future LENGTH frames, and used as the initial value of the reconstructed noise energy gain parameter $G_{ref}$ and spectral parameter $lsf_{ref}$. Reconstruction of the initial value of the energy gain parameter $G_{ref}$ and reconstruction of the initial value of the spectral parameter $lsf_{ref}$ as follows:

$$lsf_{ref}=lsf_{sid(1)}$$

$$G_{ref}=G_{sid(1)}$$

In step 303, the noise parameter is reconstructed.

The reconstruction of the noise parameter starts from the receiving of the second SID frame. The energy gain parameter decoded from the latest SID frame is $G_{sid}$ and the spectral parameter is $lsf_{sid}$. For the $k^{th}$ frame subsequent to the SID frame, the noise parameter increment $d_{k,G}$ of its energy gain parameter may be obtained according to the following equation:

$$d_{k,G}=G_{sid}-G_{ref}$$

The floating radius $\Delta_G$ of its energy gain parameter may be obtained according to the following equation:

$$\Delta_G = \frac{d_{k,G}}{2*\text{LENGTH}}$$

The noise parameter increment $d_{k,lsf}$ of its spectral parameter may be written as:

$$d_{k,lsf}=lsf_{sid}-lsf_{ref}$$

The floating radius $\Delta_{lsf}^i$ of its spectral parameter may be written as:

$$\Delta_{lsf}^i = \frac{d_{k,lsf}}{2*\text{LENGTH}} \quad i = 1, 2, \ldots, M$$

where M is the order of linear prediction.

The floating center $C_{G,k}$ of the reconstructed energy gain parameter in the reconstructed noise parameter of the current frame may be obtained according to the following equation:

$$C_{G,k}=G_{ref}+2\Delta_G$$

The floating center $C_{lsf,k}^i$ of the reconstructed spectral parameter in the reconstructed noise parameter of the current frame may be obtained according to the following equation:

$$C_{lsf,k}^i=lsf_{ref}+2\Delta_{lsf}^i$$

The reconstructed energy gain parameter $G_k$ in the reconstructed noise parameter of the current frame may be obtained according to the following equation:

$$G_k=\text{rand}(C_{G,k}-|\Delta_G|, C_{G,k}+|\Delta_G|)$$

The reconstructed spectral parameter $lsf_k^i$ in the reconstructed noise parameter of the current frame may be obtained according to the following equation:

$$lsf_k^i=\text{rand}(C_{lsf,k}^i-|\Delta_{lsf}^i|, C_{lsf,k}^i+|\Delta_{lsf}^i|)$$

where function rand(a,b) is a random value uniformly distributed within the interval [a, b].

Upon receiving a new SID frame, the associated variables may be updated as follows.

$$\text{length}=k-1;$$

$$G_{ref}=G_{k-1};$$

$$lsf_{ref}=lsf_{k-1}; \text{ and}$$

$$\text{finally } k=1.$$

Upon receiving a NO_DATA frame, the initial value of the reconstructed parameter may be updated so that:

$$G_{ref}=G_k; \text{ and}$$

$$lsf_{ref}=lsf_k.$$

The initial value of the reconstructed parameter may be updated, and then k=k+1.

The reconstruction of the noise parameter of the frame continues until receiving a new SID frame.

In step 304, noise is generated by using the reconstructed noise parameter.

A white noise excitation signal e(n) is synthesized by using a random sequence generator and the reconstruct energy gain parameter $G_k$.

The reconstructed spectral parameter $lsf_k$ is used for forming a synthesis filter $a_k(z)$.

The generated excitation signal may be synthesis filtered with a synthesis filter.

$$y_k(n)=e(n)*a_k(n)$$

After a further post filtering, comfortable noise may be recovered at the decoder.

In this embodiment, step 304 uses the method for noise generation with the reconstructed noise parameter, that is, the above mentioned second method for noise generation with the excitation signal and the reconstructed noise parameter.

In this embodiment, there is no limit to the protocol standards used in the encoder. No matter whether the encoder transmits SID frames at fixed intervals or transmits SID frames at adaptive intervals, smooth noise parameters may be reconstructed, including the energy gain parameter, the spectral parameter, etc. Then, natural comfortable noise may be generated.

When a change occurs from the speech segment to the noise segment, the noise parameter of the newly received SID frame may be used for generating noise between the first SID frame and the next SID frame. Each time a new SID frame is received, the noise parameter is reconstructed and then noise is generated by taking the reconstructed noise parameter of its previous frame as the initial value and referring to the newly received noise parameter. When a change occurs from the speech segment to the noise segment, the transmitted SID frame is very close to the speech segment. Thus, the noise parameter of the newly received SID frame is used directly to generate noise between the first SID frame and the next SID frame. The transition from the speech segment to the noise segment will be natural. The interval between two SID frames is very short. Thus noise has no change in a short time period, and cannot be discerned by the listening experience of an ordinary person. Therefore, the user may have a better listening experience. Each time a new SID frame is received, the noise parameter is reconstructed by taking the reconstructed noise parameter of its previous frame as the initial value and referring to the newly received noise parameter. The transition of the generated noise is natural, and the user may have a better listening experience. Meanwhile, by referring to the influence of the actual noise parameter, the user may discern the approximate speech environment. Further, when a NO_DATA frame is processed, based on the distance between the NO_DATA frame and the latest SID frame, the changing direction of the noise parameter of the latest SID frame, and the difference between the noise parameter of the latest SID frame and the initial value of the reconstructed parameter, the noise parameter is reconstructed for the NO_DATA frame which may have a slight change relative to the previous frame so that the reconstructed noise parameter has a smooth changing curve. Therefore, the transition of the generated noise is more natural between frames, and the user may have a better listening experience.

Figure 4:
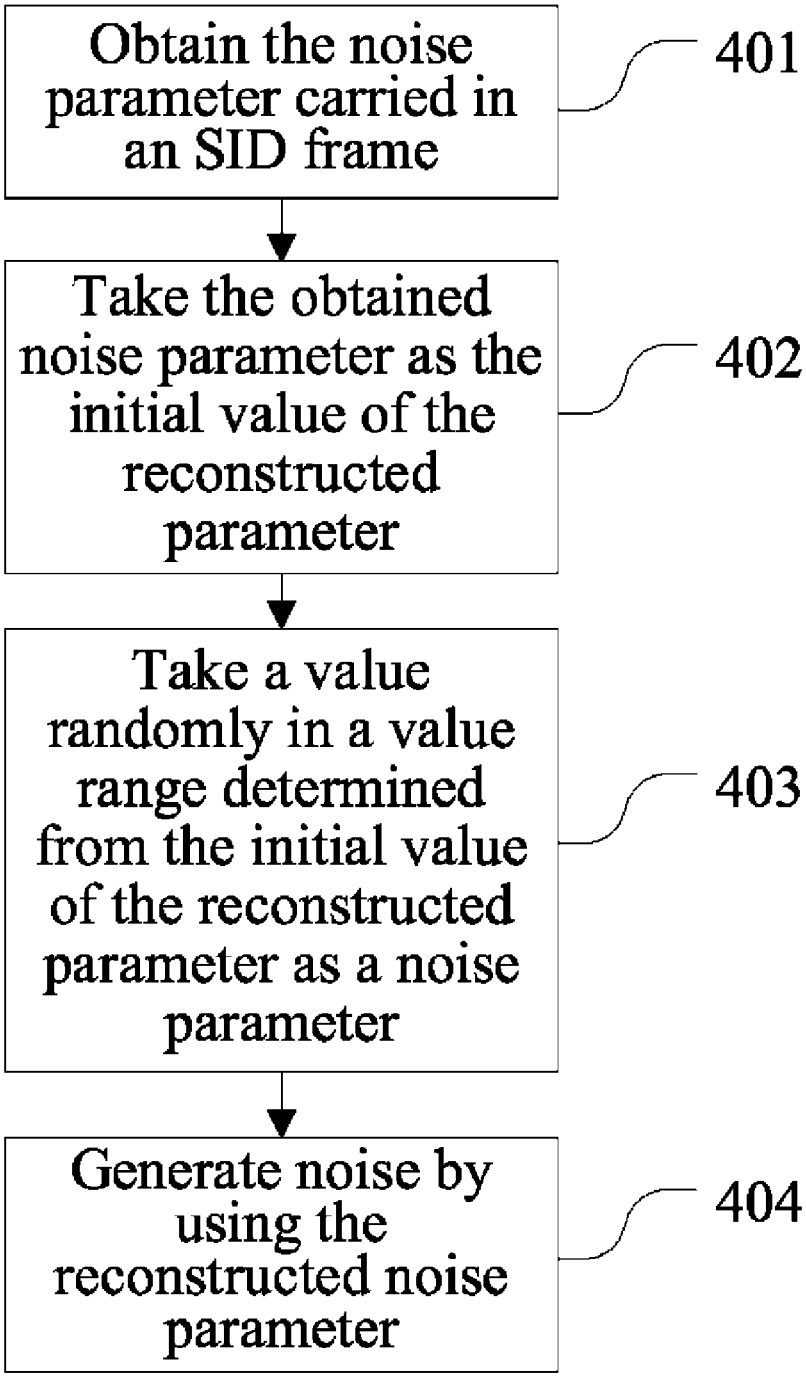
FIG. 4 is a flow chart showing a method for noise generation according to yet another embodiment of the invention.

In the method for noise generation as provided in embodiment Four of the invention, the encoder transmits SID frames at adaptive intervals. The flow chart is shown in FIG. 4.

In step 401, an SID frame is received, and the noise parameter carried in the SID frame is obtained.

After voice communication starts, the decoder may decode information about a frame from the received data packets. Then, a determination is made regarding the format of the frame. If the frame is a speech frame, the speech frame processing flow is started. If the frame is a non-speech frame, such as an SID frame or NO_DATA frame, the flow of the method for noise generation as provided in this embodiment is started.

When a non-speech frame is processed, the procedure directly proceeds to step 402 because the NO_DATA frame contains no speech data. Upon receiving an SID frame, the noise parameter carried in the SID frame may be obtained, that is, the signal energy gain parameter $G_{sid}$ and the spectral parameter $lsf_{sid}$.

In step 402, the initial value of the reconstructed parameter is obtained.

When the decoder detects that the frame type is changing from a speech frame to a non-speech frame, that is, when receiving the first SID frame, it is assumed that the signal energy gain parameter obtained from the frame is $G_{sid(1)}$ and the spectral parameter is $lsf_{sid(1)}$. Reconstruction of the initial value of the energy gain parameter $G_{ref}$ and reconstruction of the initial value of the spectral parameter $lsf_{ref}$ may be obtained according to the following equation:

$$G_{ref}=G_{sid(1)}$$

$$lsf_{ref}=lsf_{sid(1)}$$

If the received SID frame is not the first SID frame, the energy gain parameter and spectral parameter reconstructed for the frame previous to the SID frame may be used as the initial value of the reconstructed parameter.

When the noise parameter is reconstructed for the NO_DATA frame in this embodiment, the initial value of the reconstructed parameter may be updated by using the energy gain parameter and spectral parameter reconstructed for the previous frame. Alternatively, the initial value of the reconstructed parameter may not be updated before the arrival of the next SID frame.

In step 403, the noise parameter is reconstructed.

When a change occurs from the speech segment to the noise segment, in other words, when the first SID frame subsequent to the speech frame is received, the initial value of length is set to $N_p$. Afterwards, when another SID frame is received, the length of the interval between the latest SID frame and its previous SID frame is taken. To guarantee the efficiency of DTX, the transmission interval for SID frames generally is limited, that is, length must be more than or equal to a natural number. For example, it is defined in the protocol G.729B release that length must be more than or equal to 2.

The energy gain parameter decoded by the decoder from the latest SID frame is $G_{sid(n)}$ and the spectral parameter is $lsf_{sid(n)}$, (n=1, 2, . . . ) so that:

$$d_{0,G}=G_{sid(n)}-G_{sid(n-1)}$$

$$d_{0,lsf}=lsf_{sid(n)}-lsf_{sid(n-1)}$$

For the $k^{th}$ frame subsequent to the $n^{th}$ SID frame, the noise parameter increment $d_{k,G}$ of its energy gain parameter may be written as:

$$d_{k,G}=d_{0,G}-(G_{ref}-G_0)$$

where $G_{ref}$ is the initial value of the reconstructed parameter in the energy gain parameter, and $G_0$ is the energy gain parameter reconstructed for the frame previous to the newly received SID frame.

When the newly received SID frame is the first frame SID frame, $G_0$ is the weighted average value $G_{sid(0)}$ of the energy gain parameters for the previous $N_p$ frames stored in the buffer. $G_{sid(0)}$ may be written as follows:

$$G_{sid(0)} = \sum_{i=1}^{N_p} w_i \times G_i$$

where $w_i$ is the weight value and $$\sum_{i=1}^{N_p} w_i = 1.$$

The floating radius $\Delta_G$ of its energy gain parameter may be written as:

$$\Delta_G = \frac{d_{k,G}}{2(|k - \text{length}| + 1)}$$

The noise parameter increment $d_{k,lsf}^{i}$ of its spectral parameter may be written as:

$$d_{k,lsf}^{i} = d_{0,lsf} - (lsf_{ref} - lsf_0)$$

where $lsf_{ref}$ is the initial value of the reconstructed parameter for the spectral parameter, and $lsf_0$ is the spectral parameter reconstructed for the frame previous to the newly received SID frame.

When the newly received SID frame is the first frame SID frame, $lsf_0$ is the weighted average value $lsf_{sid(0)}$ of the energy gain parameters for the previous $N_p$ frames stored in the buffer. $lsf_{sid(0)}$ may be written as follows:

$$lsf_{sid(0)} = lsf_0 = \sum_{i=1}^{N_p} w_i \times lsf_i$$

where $w_i$ is the weight value and $$\sum_{i=1}^{N_p} w_i = 1.$$

The floating radius $\Delta_{lsf}^{i}$ of its spectral parameter may be written as:

$$\Delta_{lsf}^{i} = \frac{d_{k,lsf}^{i}}{2(|k - \text{length}| + 1)} \quad i = 1, 2, \ldots, M$$

where M is the order of linear prediction for the spectral parameter.

The floating center $C_{G,k}$ of the reconstructed energy gain parameter in the reconstructed noise parameter of the current frame may be written as:

$$C_{G,k} = G_{ref} + 2\Delta_G$$

The floating center $C_{lsf,k}^{i}$ of the reconstructed spectral parameter in the reconstructed noise parameter of the current frame may be written as:

$$C_{lsf,k}^{i} = lsf_{ref} + 2\Delta_{lsf}^{i}$$

The reconstructed energy gain parameter $G_k$ in the reconstructed noise parameter of the current frame may be written as:

$$G_k = \text{rand}(C_{G,k} - |\Delta_G|, C_{G,k} + |\Delta_G|)$$

The reconstructed spectral parameter $lsf_k^{i}$ in the reconstructed noise parameter of the current frame may be written as:

$$lsf_k^{i} = \text{rand}(C_{lsf,k}^{i} - |\Delta_{lsf}^{i}|, C_{lsf,k}^{i} + |\Delta_{lsf}^{i}|)$$

where function rand(a,b) means taking a random value uniformly distributed in the interval [a, b].

When a new SID frame is received, the associated variables may be updated as follows:

$$\text{length} = k - 1;$$

$$G_{ref} = G_{k-1};$$

$$lsf_{ref} = lsf_{k-1}^{i}; \text{ and}$$

finally $k=1$.

When a NO_DATA frame is received, the initial value of the reconstructed parameter is updated so that:

$$G_{ref} = G_k; \text{ and}$$

$$lsf_{ref} = lsf_k.$$

The initial value of the reconstructed parameter is updated, and then k=k+1.

The reconstruction of the noise parameter of the frame continues until a new SID frame is received.

In step 404, the reconstructed noise parameter is employed to generate noise.

A white noise excitation signal e(n) is generated with a random sequence.

The reconstructed spectral parameter $lsf_k$ is employed to form a synthesis filter $a_k(z)$.

The synthesis filter is used for synthesis filtering the generated excitation signal:

$$y_k(n) = e(n) * a_k(n)$$

Then, the reconstructed energy gain parameter $G_k$ is used for performing a time-domain shaping on the synthesized noise $y_k(n)$:

$$y(n) = y_k(n) \times \frac{G_k}{\sqrt{\sum_{i=0}^{N-1} y_k^2(n)}}$$

where N is the length of frame in which comfortable noise may be recovered at the decoder.

In this embodiment, step 404 uses the method for noise generation with the reconstructed noise parameter, that is, the first method for noise generation with the excitation signal and the reconstructed noise parameter.

In this embodiment, there is no limit to the protocol standards used at the encoder. No matter whether the encoder transmits SID frames at fixed intervals or transmits SID frames at adaptive intervals, a smooth noise parameter may be reconstructed, including the energy gain parameter, the spectral parameter, etc. Thus, natural comfortable noise may be generated.

When a transition occurs from the speech segment to the noise segment, the noise parameter is reconstructed by taking the noise parameter of the newly received SID frame as the initial value and referring to the newly received noise parameter. When a change occurs from the speech segment to the noise segment, the transmitted SID frame is very close to the speech segment. Thus, the noise parameter of the newly received SID frame may be used directly as the initial value. Therefore, the transition from the speech segment to the noise segment will be more natural. Every time a new SID frame is received, the reconstructed noise parameter of the previous frame will be taken as the initial value. The reconstruction of the noise parameter also refers to the newly received noise parameter. Thus, the transition of the generated noise will be more natural and the user may have a better listening experience. Meanwhile, by referring to the influence of the actual noise parameter, the user may discern the approximate speech environment. Further, the noise parameter increment which has a further influence on the random value range of the reconstruct noise parameter is obtained according to the difference between the latest SID frame and the previous SID frame, and the difference between the initial value of the reconstructed parameter and the noise parameter reconstructed for the frame previous to the latest SID frame. The value range influenced by the noise parameter increment changes smoothly relative to the previous frame. The reconstructed noise parameter having a random value within this range will be influenced accordingly so that the changing curve of the reconstructed noise parameter is smooth. Therefore, the transition of the generated noise between frames will be more natural, and a better listening experience may be brought to the user.

The apparatus for noise generation as provided in an embodiment of the invention is generally located in the decoder. The noise parameter having a random change and a smooth curve may be reconstructed through the use of the noise parameters of a small number of SID frames, and noise comfortable to the user experience may be recovered.

Those skilled in the art may understand that all or some of the steps in the above method according to the embodiments of the invention may be implemented by a program to instruct the associated hardware. The program may be stored in a computer readable media. When the program is executed, the above mentioned storage media may be a Read Only Memory (ROM), a magnetic disk, an optic disc, etc.

Figure 5:
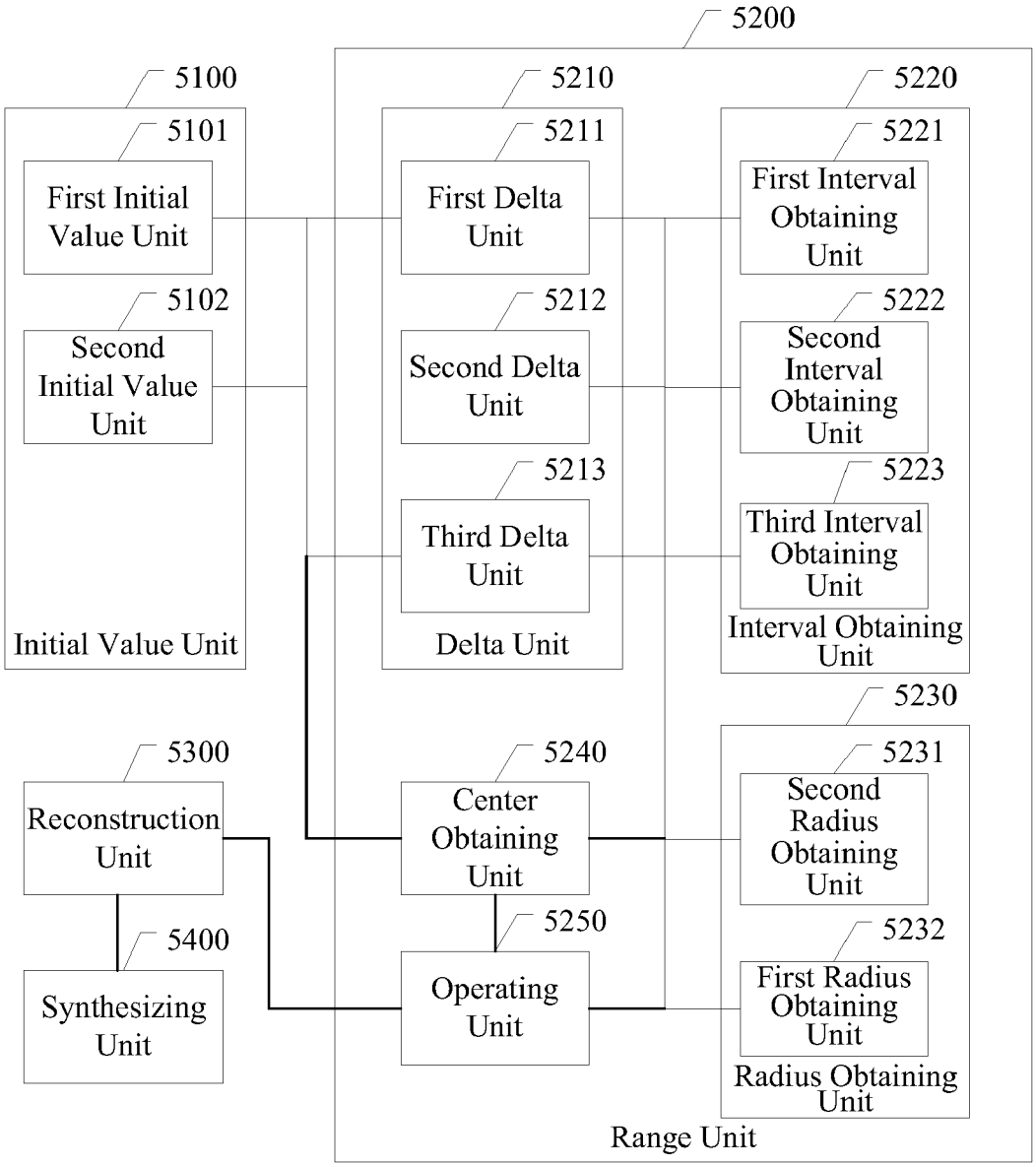
FIG. 5 is a block diagram showing the configuration of an apparatus for noise generation according to one embodiment of the invention.

The apparatus for noise generation as provided in an embodiment of the invention may have a configuration of FIG. 5 and include the following components.

an initial value unit 5100, configured to obtain an initial value of a reconstructed parameter according to a noise parameter obtained in advance;

a range unit 5200, configured to obtain a random value range based on the initial value of the reconstructed parameter;

a reconstruction unit 5300, configured to take a value in the random value range randomly as a reconstructed noise parameter; and a synthesizing unit 5400, configured to synthesize noise by using the reconstructed noise parameter.

The decoder uses a random sequence generator to synthesize an excitation signal. When noise is reconstructed, the excitation signal is equivalent to what an SID frame lacks as compared to an ordinary speech frame, for example, parameters associated with the fixed codebook and the adaptive codebook, etc. Based on the commonness of noise, the decoder uses a random sequence generator to synthesize an excitation signal for noise reconstruction.

The synthesizing unit 5400 may use two methods for noise generation with the excitation signal and the reconstructed noise parameter.

In the first method, the synthesizing unit 5400 converts the spectral parameter in the reconstructed noise parameter to synthesis filter coefficients, synthesis filters the excitation signal, and obtains a noise signal. Then, a time-domain shaping is performed on the synthesized noise signal by using the energy gain parameter in the reconstructed noise parameter. A post processing is performed, and the final reconstructed noise may be output.

In the second method, the synthesizing unit 5400 uses the energy gain parameter in the reconstructed noise parameter and the random sequence generator to synthesize an excitation signal. Then, the spectral parameter in the reconstructed noise parameter is converted to the synthesis filter coefficients. A synthesis filter is applied to the excitation signal to obtain the noise signal.

The initial value unit 5100 may include a first initial value unit 5101, and optionally a second initial value unit 5102.

The first initial value unit 5101 is configured to: upon receiving a first SID frame, take the average value or weighted average value of the noise parameters for a predetermined number of frames previous to the SID frame as the initial value of the reconstructed parameter.

The second initial value unit 5102 is configured to: upon receiving any SID frame subsequent to receiving the first SID frame, take the reconstructed noise parameter for a frame previous to the newly received SID frame as the initial value of the reconstructed parameter; or when reconstructing the noise parameter for a NO_DATA frame, take the reconstructed noise parameter for a frame previous to the NO_DATA frame as the initial value of the reconstructed parameter.

The range unit 5200 may include:

an increment unit 5210, configured to obtain a noise parameter increment based on a noise parameter obtained from an SID frame;

an interval obtaining unit 5220, configured to obtain a predicted interval length;

a radius obtaining unit 5230, configured to obtain a floating radius based on the predicted interval length and the noise parameter increment;

a center obtaining unit, configured to obtain a floating center based on the initial value of the reconstructed parameter and the floating radius; and an operating unit 5240, configured to determine the random value range by taking the floating center as the center of the random value range and taking the floating radius as the radius of the random value range.

The increment unit 5210 may include a first increment unit 5211, a second increment unit 5212, or a third increment unit 5213.

The first increment unit 5211 is configured to take the difference between a noise parameter obtained from a newly obtained SID frame and the initial value of the reconstructed parameter as the noise parameter increment.

The second increment unit 5212 is configured to take the difference between a noise parameter obtained from a newly obtained SID frame and a noise parameter obtained from a previous SID frame as the noise parameter increment.

The third increment unit 5213 is configured to take the difference between the difference between a noise parameter obtained from a newly obtained SID frame and a noise parameter obtained from a previous SID frame and the difference between the initial value of the reconstructed parameter and a reconstructed noise parameter for the frame previous to the newly obtained SID frame, as the noise parameter increment.

The radius obtaining unit 5230 may include a first radius obtaining unit 5231 or a second radius obtaining unit 5232.

The first radius obtaining unit 5231 is configured to obtain the floating radius by dividing the noise parameter increment by twice the predicted interval length.

The second radius obtaining unit 5232 is configured to obtain the floating radius based on the noise parameter increment, the predicted interval length, and the distance between the current frame and the newly received SID frame.

The interval obtaining unit 5220 may include a first interval obtaining unit 5221 or a second interval obtaining unit 5222, and optionally a third interval obtaining unit 5223.

The first interval obtaining unit 5221 is configured to take a predetermined value as the length of the interval upon receiving a first SID frame.

The second interval obtaining unit 5222 is configured to upon receiving a first SID frame, take a Transmission Speech Insertion Descriptor frame interval set by the system as the length of the interval.

The third interval obtaining unit 5223 is configured to when receiving any SID frame subsequent to receiving the first SID frame or reconstructing the noise parameter for a NO_DATA frame, take the length of the interval between a newly received SID frame and a previously received SID frame as the predicted interval length.

The method of operating the apparatus for noise generation as provided in the embodiment of the invention is substantially similar to the above method for noise generation as provided in the embodiments of the invention, and thus no repetition is made here.

In this embodiment, there is no limit to the protocol standards used in the encoder. The technical solution of the invention is operable whether the encoder transmits SID frames at fixed intervals or transmits SID frames at adaptive intervals. Moreover, each time a new SID frame is received, noise parameter reconstruction will refer to the reconstructed noise parameter of the previous frame and the newly received noise parameter. Thus, the transition of the generated noise is more natural and a better listening experience may be brought to the user. Moreover, the influence of the actual noise parameter is referred to so that the user may discern the approximate speech environment. Further, when a NO_DATA frame is processed, a noise parameter having a slight change relative to the previous frame is reconstructed for the NO_DATA frame based on the distance between the NO_DATA frame and the latest SID frame, the changing direction of the noise parameter of the latest SID frame, and the difference between the noise parameter of the latest SID frame and the initial value of the reconstructed parameter. In this way, the changing curve of the reconstructed noise parameter is smooth. Accordingly, the transition of the generated noise is more natural between frames, and a better listening experience may be brought to the user.

Detailed descriptions have been made above to the apparatus and method for noise generation as provided in the invention. Some specific exemplary embodiments are taken to explain the principles and implementations of the invention, which are merely used for facilitating the understanding of the method and the basic idea of the invention. To those skilled in the art, various changes are possible without departing from the scope of the invention. Therefore, the above description shall not be construed to limit the scope of the invention.

What is claimed is:

1. A method for noise generation, comprising:

determining an initial value of a reconstructed parameter;

determining a random value range based on the initial value of the reconstructed parameter, wherein the process of determining the random value range based on the initial value of the reconstructed parameter comprises:

determining a noise parameter increment based on a noise parameter obtained from an SID (Silence Insertion Descriptor) frame;

determining a predicted interval length, and determining a floating radius based on the predicted interval length and the noise parameter increment;

determining a floating center based on the initial value of the reconstructed parameter and the floating radius; and determining the random value range by taking the floating center as a center of the random value range and taking the floating radius as a radius of the random value range;

taking a value in the random value range randomly as a reconstructed noise parameter; and generating noise by using the reconstructed noise parameter.

2. The method for noise generation according to claim 1, wherein the process of determining the initial value of the reconstructed parameter comprises:

upon receiving a first Silence Insertion Descriptor (SID) frame, taking an average value or weighted average value of the noise parameters for a predetermined number of frames previous to the first SID frame as the initial value of the reconstructed parameter.

3. The method for noise generation according to claim 2, wherein the process of determining the initial value of the reconstructed parameter further comprises:

upon receiving any SID frame subsequent to the receiving of the first SID frame, taking the reconstructed noise parameter for a frame previous to the newly received SID frame as the initial value of the reconstructed parameter; or when a noise parameter is reconstructed for a NO_DATA frame, taking the reconstructed noise parameter for a frame previous to the NO_DATA frame as the initial value of the reconstructed parameter.

4. The method for noise generation according to claim 1, wherein the process of determining the floating center based on the initial value of the reconstructed parameter and the floating radius comprises:

taking the sum of the initial value of the reconstructed parameter and twice the floating radius as the floating center.

5. The method for noise generation according to claim 1, wherein the process of determining the noise parameter increment based on the noise parameter obtained from the SID frame comprises:

taking a difference between a noise parameter obtained from a newly obtained SID frame and the initial value of the reconstructed parameter as the noise parameter increment; or taking a difference between a noise parameter obtained from a newly obtained SID frame and a noise parameter obtained from a previous SID frame as the noise parameter increment; or taking a difference between a noise parameter obtained from a newly obtained SID frame and a noise parameter obtained from a previous SID frame and a difference between the initial value of the reconstructed parameter and the reconstructed noise parameter for a frame previous to the newly obtained SID frame, as the noise parameter increment.

6. The method for noise generation according to claim 1, wherein the process of determining the floating radius based on the predicted interval length and the noise parameter increment comprises:

taking $$\frac{dP}{2 * \text{length}}$$

as the floating radius; or taking $$\frac{dP}{2(|k - \text{length}| + 1)}$$

as the floating radius;

where dP is the noise parameter increment, length is predicted interval length, and k is the distance between the current frame and the newly received SID frame.

7. The method for noise generation according to claim 1, wherein the process of determining the predicted interval length comprises:

upon receiving a first SID frame, taking a predetermined value as the predicted interval length; or taking a Silence Insertion Descriptor frame interval set by the system as the predicted interval length.

8. The method for noise generation according to claim 7, wherein the process of determining the predicted interval length further comprises:

when receiving any SID frame subsequent to receiving the first SID frame or reconstructing the noise parameter for a NO_DATA frame, taking a length of the interval between the newly received SID frame and a previously received SID frame as the predicted interval length.

9. The method for noise generation according to claim 1, wherein the noise parameter comprises an energy parameter and a spectral parameter.

10. An apparatus for noise generation, comprising:

an initial value unit, configured to determine an initial value of a reconstructed parameter;

a range unit, configured to determine a random value range based on the initial value of the reconstructed parameter, wherein the range unit comprises:

an increment unit, configured to determine a noise parameter increment based on a noise parameter obtained from an SID (Silence Insertion Descriptor) frame;

an interval obtaining unit, configured to determine a predicted interval length;

a radius obtaining unit, configured to determine a floating radius based on the predicted interval length and the noise parameter increment;

a center obtaining unit, configured to determine a floating center based on the initial value of the reconstructed parameter and the floating radius; and an operating unit, configured to determine the random value range by taking the floating center as a center of the random value range and taking the floating radius as a radius of the random value range;

a reconstruction unit, configured to take a value in the random value range randomly as a reconstructed noise parameter; and a synthesizing unit, configured to generate noise by using the reconstructed noise parameter.

11. The apparatus for noise generation according to claim 10, wherein the initial value unit comprises a first initial value unit configured to:

upon receiving a first SID frame, take an average value or weighted average value of the noise parameters for a predetermined number of frames previous to the SID frame as the initial value of the reconstructed parameter.

12. The apparatus for noise generation according to claim 11, wherein the initial value unit further comprises a second initial value unit configured to:

upon receiving any SID frame subsequent to receiving the first SID frame, take the reconstructed noise parameter for a frame previous to the newly received SID frame as the initial value of the reconstructed parameter; or when reconstructing the noise parameter for a NO_DATA frame, take the reconstructed noise parameter for a frame previous to the NO_DATA frame as the initial value of the reconstructed parameter.

13. The apparatus for noise generation according to claim 10, wherein the increment unit comprises:

a first increment unit, configured to take a difference between a noise parameter obtained from a newly obtained SID frame and the initial value of the reconstructed parameter as the noise parameter increment; or a second increment unit, configured to take a difference between a noise parameter obtained from a newly obtained SID frame and a noise parameter obtained from a previous SID frame as the noise parameter increment; or a third increment unit, configured to take a difference between the difference between a noise parameter obtained from a newly obtained SID frame and a noise parameter obtained from a previous SID frame and a difference between the initial value of the reconstructed parameter and the reconstructed noise parameter for a frame previous to the newly obtained SID frame, as the noise parameter increment.

14. The apparatus for noise generation according to claim 10, wherein the radius obtaining unit comprises:

a first radius obtaining unit, configured to obtain the floating radius by dividing the noise parameter increment by twice the predicted interval length; or a second radius obtaining unit, configured to obtain the floating radius based on the noise parameter increment, the predicted interval length, and the distance between the current frame and the newly received SID frame.

15. The apparatus for noise generation according to claim 10, wherein the interval obtaining unit comprises:

a first interval obtaining unit, configured to take a predetermined value as the length of the interval upon receiving a first SID frame; or a second interval obtaining unit, configured to take a Transmission Speech Insertion Descriptor frame interval set by system as the length of the interval upon receiving a first SID frame.

16. The apparatus for noise generation according to claim 15, wherein the interval obtaining unit further comprises a third interval obtaining unit configured to:

when receiving any SID frame subsequent to receiving the first SID frame or reconstructing the noise parameter for a NO_DATA frame, take a length of the interval between a newly received SID frame and a previously received SID frame as the predicted interval length.

17. A non-transitory computer readable storage medium, storing computer program codes which when executed by a computer processor cause the compute processor to execute the steps of:

determining an initial value of a reconstructed parameter;

determining a random value range based on the initial value of the reconstructed parameter, wherein the process of determining the random value range based on the initial value of the reconstructed parameter comprises:

determining a noise parameter increment based on a noise parameter obtained from an SID (Silence Insertion Descriptor) frame;

determining a predicted interval length, and determining a floating radius based on the predicted interval length and the noise parameter increment;

determining a floating center based on the initial value of the reconstructed parameter and the floating radius; and determining the random value range by taking the floating center as a center of the random value range and taking the floating radius as a radius of the random value range;

taking a value in the random value range randomly as a reconstructed noise parameter; and generating noise by using the reconstructed noise parameter.

* * * * *

UNITED STATES PATENT AND TRADEMARK OFFICE

CERTIFICATE OF CORRECTION

PATENT NO. : 8,296,132 B2
APPLICATION NO. : 12/748190
DATED : October 23, 2012
INVENTOR(S) : Zhang et al.

It is certified that error appears in the above-identified patent and that said Letters Patent is hereby corrected as shown below:

Column 24, line 8-9, "a difference between the difference between" should read -- the difference between --.

Signed and Sealed this
Nineteenth Day of March, 2013

Teresa Stanek Rea
*Acting Director of the United States Patent and Trademark Office*